US010618702B1

(12) United States Patent
Alexander

(10) Patent No.: US 10,618,702 B1
(45) Date of Patent: Apr. 14, 2020

(54) PET FOOD STORAGE CONTAINER

(71) Applicant: Daphne Alexander, Huntington Station, NY (US)

(72) Inventor: Daphne Alexander, Huntington Station, NY (US)

( * ) Notice: Subject to any disclaimer, the term of this patent is extended or adjusted under 35 U.S.C. 154(b) by 0 days.

(21) Appl. No.: 16/268,638

(22) Filed: Feb. 6, 2019

(51) Int. Cl.
*B65D 43/26* (2006.01)
*B65D 25/56* (2006.01)
*B65D 25/28* (2006.01)
*B65D 43/16* (2006.01)

(52) U.S. Cl.
CPC ..... *B65D 43/262* (2013.01); *B65D 25/2808* (2013.01); *B65D 25/56* (2013.01); *B65D 43/163* (2013.01)

(58) Field of Classification Search
CPC .... B65D 43/262; B65D 43/163; B65D 25/56; B65D 25/2808
See application file for complete search history.

(56) References Cited

U.S. PATENT DOCUMENTS 293,650 A * 2/1884 Gorman ..... A63B 57/60 15/104.92
1,065,823 A * 6/1913 Matthews ..... G01F 11/286 222/205
3,761,995 A * 10/1973 Rinard ..... B44D 3/126 15/257.06
3,799,430 A * 3/1974 Huguenin ..... B65F 1/06 232/43.2
4,361,247 A * 11/1982 Williams ..... A62C 3/00 220/263
4,785,964 A * 11/1988 Miller ..... B65F 1/163 220/263
4,950,094 A * 8/1990 Yorks ..... A45D 40/04 222/390
5,033,564 A * 7/1991 Mattson ..... A47L 11/00 152/323
5,147,056 A * 9/1992 Ma ..... B65F 1/163 220/263
5,213,272 A * 5/1993 Gallagher ..... B02C 18/0084 241/33
5,249,693 A * 10/1993 Gillispie ..... B65F 1/163 220/260
5,348,222 A * 9/1994 Patey ..... B65F 1/006 220/262
5,356,037 A * 10/1994 Harrold ..... B65D 83/0005 222/105
5,372,271 A * 12/1994 Miller ..... B65F 1/1607 220/263
5,458,232 A * 10/1995 Novak ..... B65G 1/07 206/556
5,474,201 A * 12/1995 Liu ..... B65F 1/163 220/23.83

(Continued)

*Primary Examiner* — Jacob B Meyer

(57) ABSTRACT

A pet food storage container for dry pet food includes a shell that defines an interior space. The shell has a top that is open. A lid that is hingedly coupled to the shell proximate to the top is positioned to selectively close the top. A spring that is positioned in the interior space is coupled to a bottom of the shell and extends toward the top. A plate is coupled to the spring distal from the bottom. The plate is configured to position dry pet food so that the spring is compressed and tensioned, positioning the spring to rebound as the dry pet food is removed from the interior space.

13 Claims, 4 Drawing Sheets

(56) References Cited

U.S. PATENT DOCUMENTS 5,511,682 A * 4/1996 Pace ..... B65F 1/06 220/230
5,575,605 A * 11/1996 Fisher ..... B62B 1/14 280/47.29
5,753,212 A * 5/1998 Pescatore ..... A45D 40/04 264/268
6,010,024 A * 1/2000 Wang ..... B65F 1/163 220/23.87
6,024,238 A * 2/2000 Jaros ..... B65F 1/163 16/84
6,047,976 A * 4/2000 Wang ..... A45C 5/03 280/37
6,082,591 A * 7/2000 Healey ..... B65D 1/023 222/158
6,644,493 B1 * 11/2003 Walton ..... B65F 1/02 220/603
6,981,606 B2 * 1/2006 Yang ..... B65F 1/163 220/23.87
7,040,249 B1 * 5/2006 Mushen ..... A01K 5/0225 119/51.5
7,077,283 B2 * 7/2006 Yang ..... B65F 1/068 220/262
7,090,092 B1 * 8/2006 Roebuck, Jr. ..... D06F 95/002 220/629
7,392,761 B2 * 7/2008 Kujawa ..... A01K 7/00 119/61.5
7,523,518 B2 * 4/2009 Futo ..... B05C 17/0217 15/114
7,527,018 B2 * 5/2009 Manley-Hood ..... A01K 5/0128 119/61.5
7,530,578 B2 * 5/2009 Niemeyer ..... B65F 1/1473 220/262
7,543,716 B2 * 6/2009 Lin ..... B65F 1/06 141/391
7,578,388 B2 * 8/2009 O'Connell ..... B05C 17/002 206/223
7,665,417 B1 * 2/2010 Harper ..... A01K 5/0114 119/51.01
7,806,285 B2 * 10/2010 Yang ..... B65F 1/08 220/264
7,913,648 B2 * 3/2011 Maeda ..... A01K 7/027 119/51.5
7,938,083 B1 * 5/2011 Huether ..... A01K 5/0114 119/61.5
8,297,470 B2 * 10/2012 Yang ..... B65F 1/08 220/263
D679,958 S * 4/2013 Yang ..... D7/629
8,448,803 B2 * 5/2013 Most ..... B65F 1/163 220/260
8,511,519 B2 * 8/2013 Mahle ..... A01K 5/0114 222/309
8,567,630 B2 * 10/2013 Yang ..... B65F 1/06 220/264
8,627,987 B2 * 1/2014 Pollack ..... B65D 83/0005 220/8
8,984,847 B1 * 3/2015 Nguyen ..... B65F 1/062 220/908.1
9,022,258 B2 * 5/2015 Nehren ..... B01F 13/1055 222/390
9,051,093 B2 * 6/2015 Yang ..... B65D 43/262
D808,223 S * 1/2018 Wassenius ..... D7/605
D808,729 S * 1/2018 Wassenius ..... D7/605
10,149,456 B2 * 12/2018 Diamond ..... A01K 5/0114
10,464,747 B2 * 11/2019 Abang, Jr. ..... B65F 1/06
2005/0121868 A1 * 6/2005 Hartman ..... A01K 5/0114 280/47.26
2005/0133511 A1 * 6/2005 Makriyiannis ..... B65D 83/005 220/578
2006/0159815 A1 * 7/2006 Crook ..... B65D 83/0005 426/394
2006/0278643 A1 * 12/2006 Chiou ..... B65F 1/06 220/263
2007/0012699 A1 * 1/2007 Yang ..... B65F 1/163 220/264
2007/0029323 A1 * 2/2007 Yang ..... B65F 1/08 220/263
2009/0145365 A1 * 6/2009 Mahle ..... A01K 5/0114 119/51.01
2010/0011798 A1 * 1/2010 Robertson ..... F25D 3/06 62/371
2010/0258584 A1 * 10/2010 Shaw ..... B65G 65/24 222/1
2010/0294769 A1 * 11/2010 Lee ..... B65F 1/163 220/263
2011/0309228 A1 * 12/2011 Cox ..... A47F 1/06 248/573
2012/0210940 A1 * 8/2012 Mahle ..... A01K 5/0114 119/53
2012/0298676 A1 * 11/2012 Cooks ..... B65D 1/04 220/592.21
2013/0048648 A1 * 2/2013 Robertson ..... F25D 3/06 220/592.02
2013/0206774 A1 * 8/2013 Menchel ..... B65D 85/36 220/529
2014/0246434 A1 * 9/2014 Yang ..... B65F 1/1615 220/264
2016/0304268 A1 * 10/2016 Schneider ..... B65D 83/0038

* cited by examiner

PET FOOD STORAGE CONTAINER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to storage containers and more particularly pertains to a new storage container for dry pet food.

BRIEF SUMMARY OF THE INVENTION

An embodiment of the disclosure meets the needs presented above by generally comprising a shell that defines an interior space. The shell has a top that is open. A lid that is hingedly coupled to the shell proximate to the top is positioned to selectively close the top. A spring that is positioned in the interior space is coupled to a bottom of the shell and extends toward the top. A plate is coupled to the spring distal from the bottom. The plate is configured to position dry pet food so that the spring is compressed and tensioned, positioning the spring to rebound as the dry pet food is removed from the interior space.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
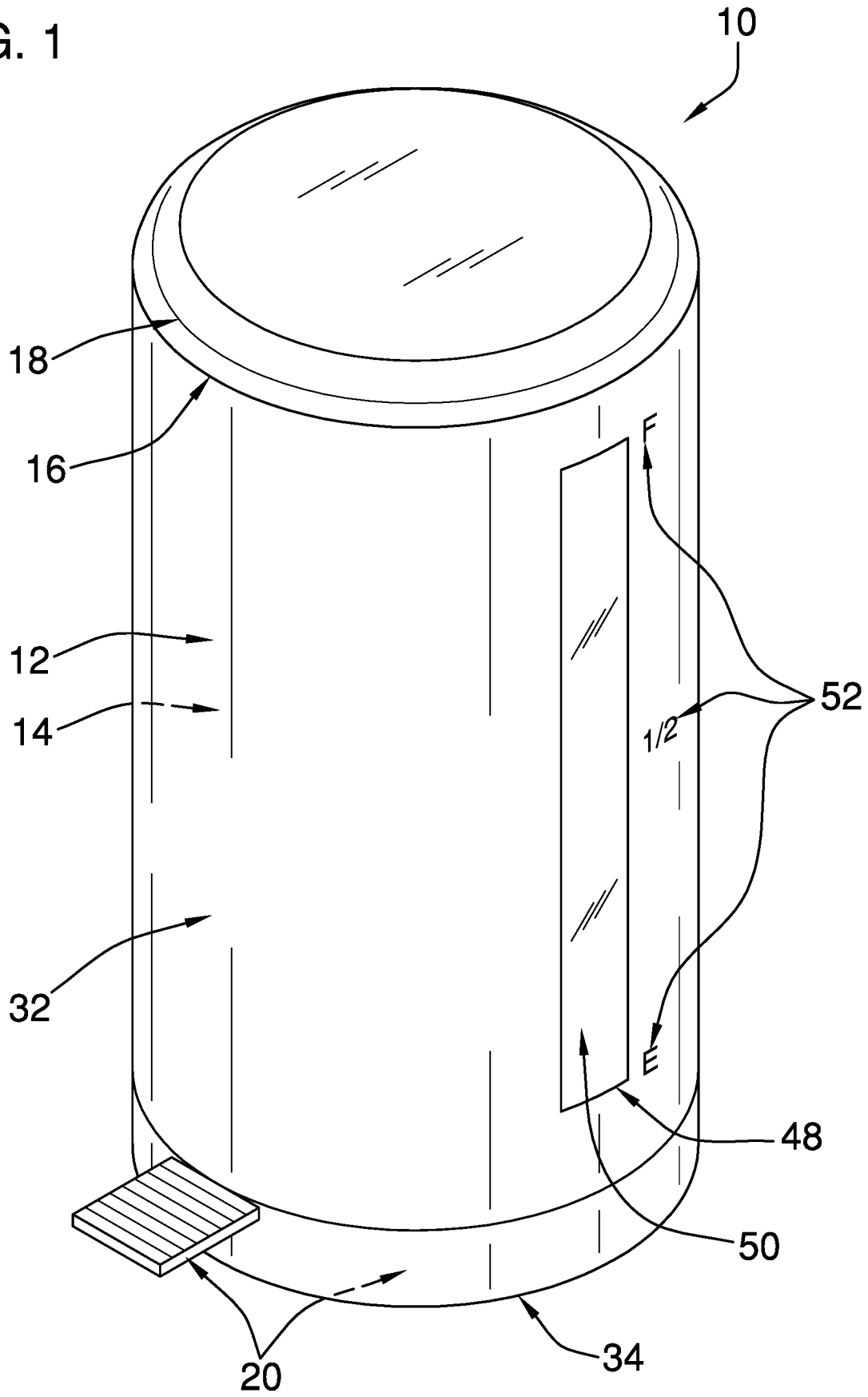
FIG. 1 is an isometric perspective view of a pet food storage container according to an embodiment of the disclosure.

With reference now to the drawings, and in particular to FIGS. 1 through 4 thereof, a new storage container embodying the principles and concepts of an embodiment of the disclosure and generally designated by the reference numeral 10 will be described.

As best illustrated in FIGS. 1 through 4, the pet food storage container 10 generally a shell 12 that defines an interior space 14. The shell 12 has a top 16 that is open. The top 16 is circularly shaped so that the shell 12 is cylindrically shaped. A lid 18 that is hingedly coupled to the shell 12 proximate to the top 16 is positioned to selectively close the top 16. An actuator 20 is coupled to the shell 12 and is operationally coupled to the lid 18. The actuator 20 is positioned to selectively pivot the lid 18 relative to the shell 12 to open the top 16.

Figure 4:
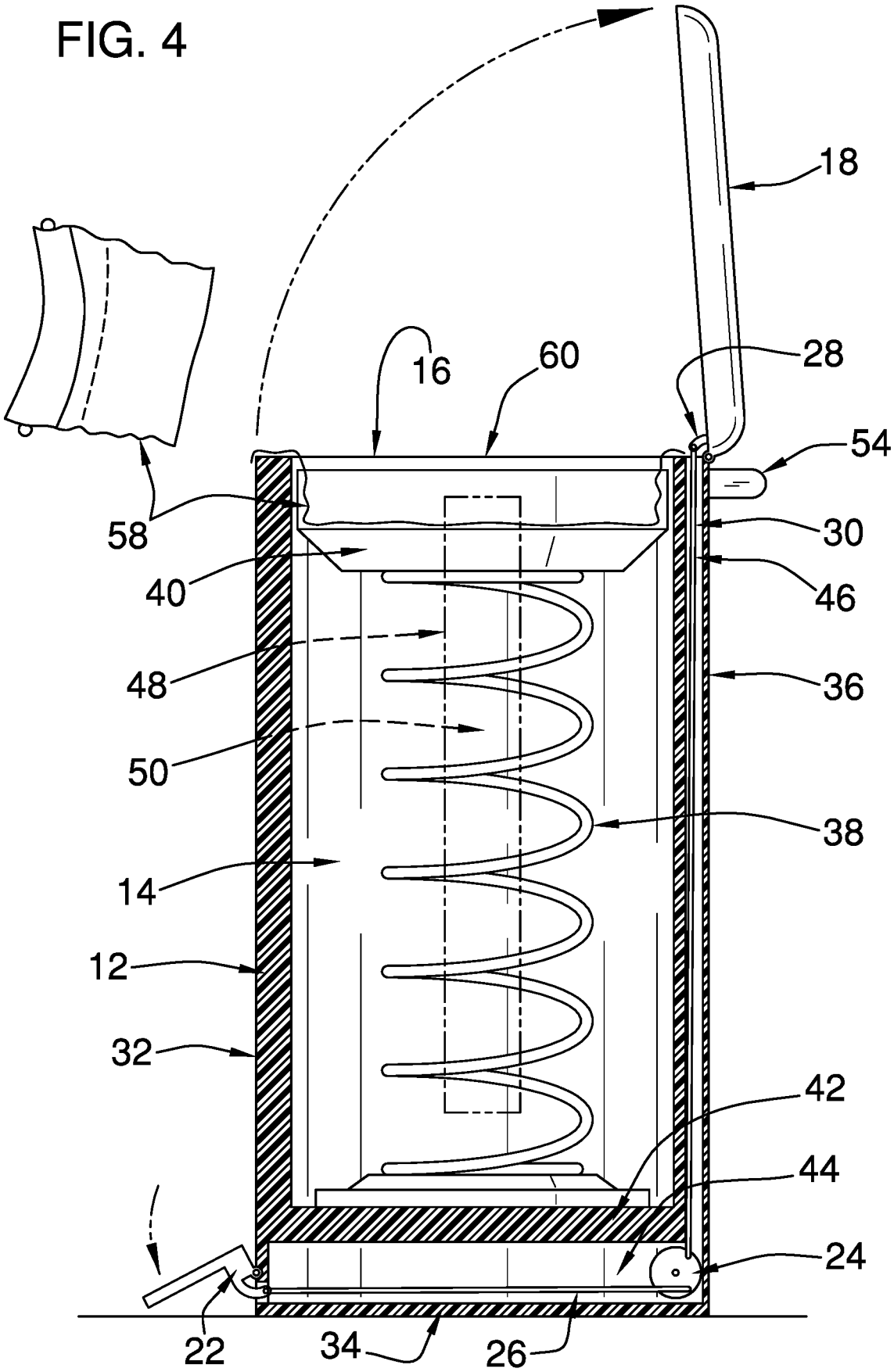
FIG. 4 is a cross-sectional view of an embodiment of the disclosure.

The actuator 20 comprises a pedal 22, a disc 24, a first rod 26, a pin 28, and a second rod 30. The pedal 22 is hingedly coupled to and extends from a front 32 of the shell 12 proximate to a bottom 34 of the shell 12. The disc 24 is positioned in the interior space 14 and is rotationally coupled to the shell 12 proximate to the bottom 34 and a back 36 of the shell 12. The first rod 26 is coupled to and extends between the disc 24 and the pedal 22. The first rod 26 is rotationally coupled to the disc 24. The pin 28 is coupled to the lid 18 proximate to the back 36 of the shell 12. The second rod 30 is coupled to and extends between the pin 28 and the disc 24. The second rod 30 is rotationally coupled to the disc 24 and is pivotally coupled to the pin 28. The pedal 22 is configured to be depressed with a foot of a user to urge the first rod 26 to rotate the disc 24 so that the second rod 30 is urged upwardly to pivot the lid 18 from the top 16, as shown in FIG. 4.

A spring 38 that is positioned in the interior space 14 is coupled to the bottom 34 of the shell 12 and extends toward the top 16. A plate 40, which is dish shaped, is coupled to the spring 38 distal from the bottom 34. The plate 40 is configured to position dry pet food so that the spring 38 is compressed and tensioned, positioning the spring 38 to rebound as the dry pet food is removed from the interior space 14.

A wall 42 is coupled to the shell 12 and is positioned in the interior space 14 proximate to the bottom 34 to define a chamber 44. The first rod 26 and the disc 24 are positioned in the chamber 44. A channel 46 is positioned in the back 36 of the housing. The channel 46 extends from the chamber 44 to the top 16. The second rod 30 is positioned in the channel 46. With the first rod 26 and the disc 24 positioned in the chamber 44, and the second rod 30 positioned in the channel 46, the actuator 20 is isolated from and protected from damage by the dry pet food that is positioned in the interior space 14.

Figure 2:
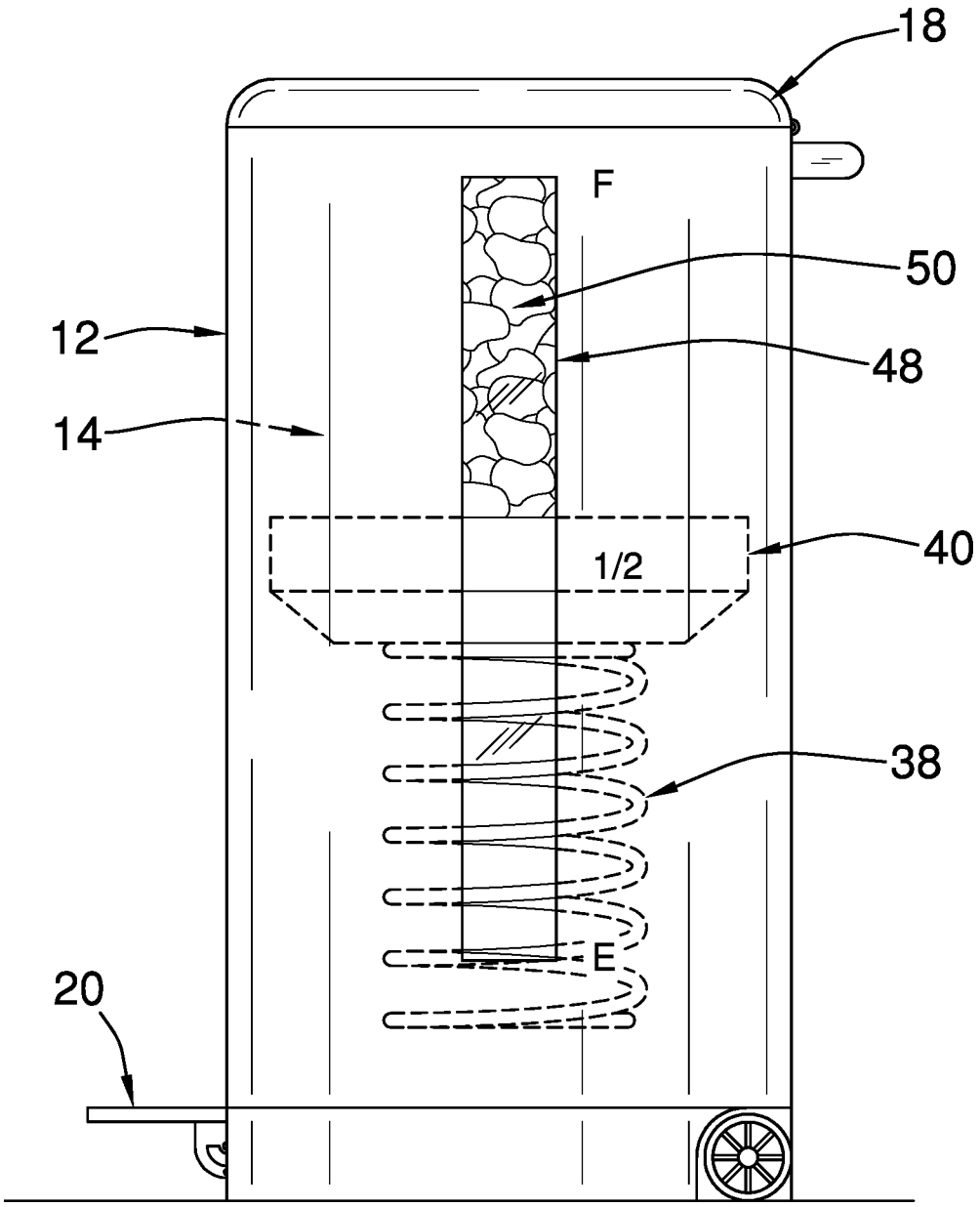
FIG. 2 is a side view of an embodiment of the disclosure.
Figure 3:
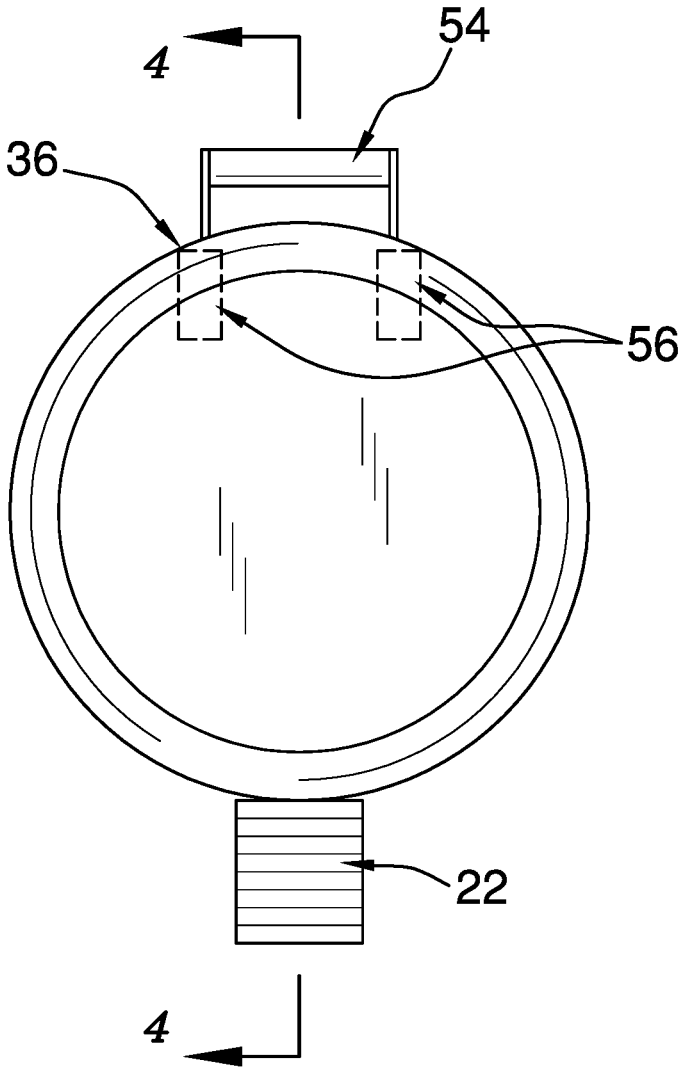
FIG. 3 is a top view of an embodiment of the disclosure.

A cutout 48 that is positioned in the shell 12 extends from proximate to the bottom 34 to proximate to the top 16 of the shell 12. The cutout 48 is elongated rectangularly shaped. A panel 50 is positioned in the cutout 48 and is coupled to the shell 12. The panel 50 is substantially transparent so that the panel 50 is configured to allow viewing of the dry pet food that is positioned in the interior space 14, as shown in FIG. 2. Indicia 52 that is coupled to the shell 12 proximate to the cutout 48 is configured to indicate a fill level of the dry pet food within the interior space 14.

A handle 54 that is coupled to the back 36 of the shell 12 proximate to the top 16 is configured to be grasped in a hand of the user to lift the shell 12. A pair of wheels 56 is rotationally coupled to the bottom 34 of the shell 12 proximate to the back 36 of the shell 12. The handle 54 is configured to be grasped in the hand of the user, positioning the user to tilt the shell 12 and to locomote the shell 12 upon the wheels 56.

Each of a plurality of bags 58 is sized complementarity to the interior space 14. A respective bag 58 is positioned to be coupled to a circumference 60 of the top 16, positioning the respective bag 58 to receive the dry pet food as the dry pet food is inserted through the top 16 into the interior space 14 so that the dry pet food is retained within the respective bag. The respective bag 58 is substantially transparent so that the respective bag 58 is configured to allow viewing of the dry pet food that is positioned in the respective bag. Use of the respective bag 58 to contain the dry pet food within the interior space 14 provides additional protection to the actuator 20 and minimizes cleaning requirements for the shell 12.

In use, the lid 18 is opened by depressing the pedal 22 and the dry pet food is poured onto the plate 40, causing the spring 38 to compress and the plate 40 to travel from the top 16 toward the bottom 34 of the shell 12 and allowing the user to substantially fill the interior space 14 with the dry pet food. As the user removes the dry pet food in portions to feed a pet, the spring 38 urges the plate 40 toward the top 16 so that the dry pet food is always readily accessible to the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pet food storage container comprising:

a shell defining an interior space, the shell having a top, the top being open;

a lid hingedly coupled to the shell proximate to the top wherein the lid is positioned for selectively closing the top;

a spring positioned in the interior space, the spring being coupled to a bottom of the shell and extending toward the top; and a plate coupled to the spring distal from the bottom wherein the plate is configured for positioning dry pet food such that the spring is compressed and tensioned positioning the spring for rebounding as the dry pet food is removed from the interior space, the plate being dish-shaped including a lower portion having a concave upper surface and a peripheral wall extending vertically up from a peripheral edge of the lower portion, the peripheral wall being parallel to an interior surface of the shell.

2. The container of claim 1, further including the top being circularly shaped such that the shell is cylindrically shaped.

3. The container of claim 1, further including an actuator coupled to the shell, the actuator being operationally coupled to the lid wherein the actuator is positioned for selectively pivoting the lid relative to the shell for opening the top.

4. The container of claim 3, further including the actuator comprising:

a pedal hingedly coupled to and extending from a front of the shell proximate to the bottom of the shell;

a disc positioned in the interior space and rotationally coupled to the shell proximate to the bottom and a back of the shell;

a first rod coupled to and extending between the disc and the pedal, the first rod being rotationally coupled to the disc;

a pin coupled to the lid proximate to the back of the shell; and a second rod coupled to and extending between the pin and the disc, the second rod being rotationally coupled to the disc and pivotally coupled to the pin wherein the pedal is configured for depressing with a foot of a user for urging the first rod for rotating the disc such that the second rod is urged upwardly for pivoting the lid from the top.

5. The container of claim 4, further comprising:

a wall coupled to the shell and positioned in the interior space proximate to the bottom defining a chamber, the first rod and the disc being positioned in the chamber; and a channel positioned in the back of the housing, the channel extending from the chamber to the top, the second rod being positioned in the channel.

6. The container of claim 1, further comprising:

a cutout positioned in the shell, the cutout extending from proximate to the bottom to proximate to the top of the shell; and a panel positioned in the cutout and coupled to the shell, the panel being substantially transparent such that the panel is configured for viewing the dry pet food positioned in the interior space.

7. The container of claim 6, further including the cutout being elongated rectangularly shaped.

8. The container of claim 6, further including indicia coupled to the shell proximate to the cutout wherein the indicia are configured for indicating a fill level of the dry pet food within the interior space.

9. The container of claim 1, further including a handle coupled to a back of the shell proximate to the top wherein the handle is configured for grasping in a hand of the user for lifting the shell.

10. The container of claim 9, further including a pair of wheels rotationally coupled to the bottom of the shell proximate to the back of the shell wherein the handle is configured grasping in the hand of the user for tilting the shell positioning the user for locomoting the shell upon the wheels.

11. The container of claim 6, further including a bag being sized complementary to the interior space such that said bag is positioned for coupling to a circumference of the top positioning the bag for receiving the dry pet food as the dry pet food is inserted through the top into the interior space such that the dry pet food is retained within the bag.

12. The container of claim 11, further including the bag being substantially transparent such that the bag is configured for viewing the dry pet food positioned in the bag.

13. A pet food storage container comprising:

a shell defining an interior space, the shell having a top, the top being open, the top being circularly shaped such that the shell is cylindrically shaped;

a lid hingedly coupled to the shell proximate to the top wherein the lid is positioned for selectively closing the top;

an actuator coupled to the shell, the actuator being operationally coupled to the lid wherein the actuator is positioned for selectively pivoting the lid relative to the shell for opening the top, the actuator comprising:

a pedal hingedly coupled to and extending from a front of the shell proximate to a bottom of the shell, a disc positioned in the interior space and rotationally coupled to the shell proximate to the bottom and a back of the shell, a first rod coupled to and extending between the disc and the pedal, the first rod being rotationally coupled to the disc, a pin coupled to the lid proximate to the back of the shell, and a second rod coupled to and extending between the pin and the disc, the second rod being rotationally coupled to the disc and pivotally coupled to the pin wherein the pedal is configured for depressing with a foot of a user for urging the first rod for rotating the disc such that the second rod is urged upwardly for pivoting the lid from the top;

a spring positioned in the interior space, the spring being coupled to the bottom of the shell and extending toward the top;

a wall coupled to the shell and positioned in the interior space proximate to the bottom defining a chamber, the first rod and the disc being positioned in the chamber;

a channel positioned in the back of the housing, the channel extending from the chamber to the top, the second rod being positioned in the channel;

a plate coupled to the spring distal from the bottom wherein the plate is configured for positioning dry pet food such that the spring is compressed and tensioned positioning the spring for rebounding as the dry pet food is removed from the interior space, the plate being dish shaped including a lower portion having a concave upper surface and a peripheral wall extending vertically up from a peripheral edge of the lower portion, the peripheral wall being parallel to an interior surface of the shell;

a cutout positioned in the shell, the cutout extending from proximate to the bottom to proximate to the top of the shell, the cutout being elongated rectangularly shaped;

a panel positioned in the cutout and coupled to the shell, the panel being substantially transparent such that the panel is configured for viewing the dry pet food positioned in the interior space;

indicia coupled to the shell proximate to the cutout wherein the indicia are configured for indicating a fill level of the dry pet food within the interior space;

a handle coupled to the back of the shell proximate to the top wherein the handle is configured for grasping in a hand of the user for lifting the shell;

a pair of wheels rotationally coupled to the bottom of the shell proximate to the back of the shell wherein the handle is configured grasping in the hand of the user for tilting the shell positioning the user for locomoting the shell upon the wheels; and a bag being sized complementary to the interior space such that the bag is positioned for coupling to a circumference of the top positioning the bag for receiving the dry pet food as the dry pet food is inserted through the top into the interior space such that the dry pet food is retained within the bag, the bag being substantially transparent such that the bag is configured for viewing the dry pet food positioned in the bag.

* * * * *